US009657568B2

(12) United States Patent
Bielenberg

(10) Patent No.: US 9,657,568 B2
(45) Date of Patent: May 23, 2017

(54) UNIFLOW STEAM ENGINE

(71) Applicant: Carl Norman Bielenberg, Orford, NH (US)

(72) Inventor: Carl Norman Bielenberg, Orford, NH (US)

(73) Assignee: Village Industrial Power, Inc., Bradford, VT (US)

( * ) Notice: Subject to any disclaimer, the term of this patent is extended or adjusted under 35 U.S.C. 154(b) by 496 days.

(21) Appl. No.: 14/158,051

(22) Filed: Jan. 17, 2014

(65) Prior Publication Data

US 2014/0196601 A1 Jul. 17, 2014

Related U.S. Application Data

(60) Provisional application No. 61/753,514, filed on Jan. 17, 2013.

(51) Int. Cl.

| | |
|---|---|
| ***F01B 1/01*** | (2006.01) |
| ***F01B 17/04*** | (2006.01) |
| ***F01L 3/20*** | (2006.01) |

(52) U.S. Cl.

CPC ..... *F01B 1/01* (2013.01); *F01B 17/04* (2013.01); *F01L 3/205* (2013.01)

(58) Field of Classification Search

CPC ..... F01B 17/04; F01B 17/00; F01B 3/0085; F01L 23/00; F01L 13/0063

USPC ..... 92/146, 161, 155; 137/855, 856; 251/15, 251/42, 44, 120, 227, 242, 902; 417/569

See application file for complete search history.

(56) References Cited

U.S. PATENT DOCUMENTS

| | | | | |
|---|---|---|---|---|
| 1,045,630 A | | 11/1912 | Stumpf | |
| 2,649,078 A | | 8/1953 | Kelly | |
| 2,671,434 A | | 3/1954 | Schmiedeskamp | |
| 2,970,608 A | * | 2/1961 | Doeg | F04B 39/102 137/516.11 |

(Continued)

FOREIGN PATENT DOCUMENTS

| | | |
|---|---|---|
| GB | 24288 A | 0/1915 |
| GB | 28137 | 0/1911 |

(Continued)

OTHER PUBLICATIONS

Emerson ("Flow Measurement: User Manual". Form No. A6043, Mar. 2005. <e-document> Retrieved on Sep. 13, 2016 <URL: http://www.emersonprocess.com/flow>.*

(Continued)

*Primary Examiner* — Michael Leslie
*Assistant Examiner* — Richard Drake
(74) *Attorney, Agent, or Firm* — Nields, Lemack & Frame, LLC

(57) ABSTRACT

Improvements to the steam engine for the purpose of small scale generation of electricity using biomass fuels and for co-generation of heat and electricity using biomass fuels in both developed and less developed countries are described. The engine is particularly well adapted to co-generation where the thermal load, as in building heating and many process applications, is extremely variable, because of its ability to operate efficiently under partial load. For the same reason, it would be suited to solar generated steam. Experiments have been conducted with steam as the working fluid. The design may in some or all respects be applied to other working fluids.

11 Claims, 9 Drawing Sheets

(56) References Cited

U.S. PATENT DOCUMENTS 3,668,974 A 6/1972 Hagdorn et al.
3,910,160 A * 10/1975 Divine ..... F01B 17/04 91/224
3,957,083 A * 5/1976 Gallo ..... F16K 1/40 137/517
4,179,952 A * 12/1979 Keske ..... F04B 5/02 184/6.12
4,352,377 A * 10/1982 Fritchman ..... F04B 39/1073 137/851
4,872,432 A * 10/1989 Rao ..... F01M 9/00 123/193.4
4,981,068 A 1/1991 Glass et al.
5,449,147 A * 9/1995 Pace ..... F01L 1/462 123/90.65
5,765,445 A * 6/1998 Miyata ..... G05G 1/04 56/DIG. 18
6,565,336 B1 * 5/2003 Fraser ..... F04B 39/1073 137/856
6,687,923 B2 * 2/2004 Dick ..... F16K 24/046 137/467
6,929,456 B2 * 8/2005 Seo ..... F04B 39/1073 417/569
7,204,353 B2 * 4/2007 Kanno ..... F16F 9/20 188/290
8,807,012 B1 * 8/2014 Bennett ..... F01L 25/063 91/270
9,291,056 B2 * 3/2016 Bennett ..... F01C 21/18

FOREIGN PATENT DOCUMENTS

GB 28606 A 0/1912
GB 191028137 A * 0/1911 ..... F01B 17/04
GB 191409888 A * 0/1915 ..... F16J 9/08
WO 2009/129129 A1 10/2009

OTHER PUBLICATIONS

International Search Report/Written Opinion mailed May 14, 2014 in corresponding PCT application No. PCT/US2014/012045.
European communication dated Sep. 6, 2016 in corresponding European patent application No. 14740796.9.

* cited by examiner

UNIFLOW STEAM ENGINE

This application claim priority of U.S. Provisional Patent Application Ser. No. 61/753,514 filed Jan. 17, 2013, the disclosure of which is incorporated herein by reference in its entirety.

BACKGROUND

The history of the steam engine is one of long and continuous innovation, with the principal goal being the increase in efficiency of the engine in converting fuel to work. This efficiency was initially extremely low (approximately 1%), and gradually increased through the $19^{th}$ Century to approximately 20% in large engines. Modern central power stations, using very high pressure steam, minimum exhaust temperatures, turbines having 50 or more stages of steam expansion, and a large amount of ancillary equipment approach 40% efficiency. There is nonetheless a need for small scale power generators and co-generators of heat and electricity that are able to burn waste biomass, as produced from crop processing in rural communities that are not served by commercial power services. It is important that such small scale generators be as efficient as possible to maximize the amount of electricity that can be produced from available biomass, as well as to minimize carbon dioxide emissions per kilowatt-hour generated.

Later efforts to improve the efficiency of the steam engine focused on increasing the pressure of the steam produced in the boiler, and reducing the duration of steam admission to the cylinder, in relation to the time required for a complete piston stroke, so that a large portion of the work done by the steam could be done by its expansion, and not simply by its displacement of the piston at boiler pressure. The expansion of steam causes a drop in its pressure and temperature, which required provisions to minimize the contact of hot boiler pressure steam with the cool exhaust steam and cooler surfaces of the engine. In addition, expansion of steam is accompanied by the condensation of a portion of the steam to water, which is extremely detrimental to the efficiency of the engine if the water remains in the cylinder. Some of the most successful steam engine designs were quite complex, having ingenious mechanisms to time the opening and closure of the steam inlet and exhaust valves, or having multiple cylinders of successively larger size, so that the high pressure, high temperature steam could be partially expanded in the small cylinder, before passing sequentially to the larger medium pressure cylinder, and finally to the largest high pressure cylinder. This design became virtually standard for marine applications, having the benefit of minimizing the heat loss from the high pressure to the low pressure steam, but also providing more equal and constant loads on the crankshaft.

One of the last innovations in reciprocating steam engine design, especially for stationery motive power, was the "Uniflow" engine, fully developed by the German inventor Stumpf in the first decade of the $20^{th}$ century. The uniflow engine was both comparatively efficient, as well as very simple. It was the first engine to have only its steam inlet valves in the cylinder heads, the exhaust being accomplished by ports or openings in the wall of the cylinder, midway along the length of the cylinder. The uniflow engine could achieve a high degree of expansion of the steam in a single cylinder, because the heads were not cooled by contact with wet, low temperature, low pressure exhaust steam. The uniflow design was licensed to steam engine manufacturers worldwide, in particular Skinner in the United States.

Further development of the steam engine during the $20^{th}$ century was arrested or severely limited by the development of the internal combustion engine for mobile applications, and the steam turbine for large scale electric power generation. The reciprocating steam engine nonetheless continued to play a very important role through the end of WWII, powering a majority of freighters and troop transport ships, as well as the majority of locomotives. An obvious advantage of the steam engine over the internal combustion engine is its ability to burn low cost solid fuels, including coal and biomass. Less well known advantages of the steam engine over the steam turbine for small scale applications include its much lower cost and its ability to operate efficiently at partial load. These advantages are relevant to the production of electricity from biomass fuels in rural communities in developing countries, as well as the cogeneration of heat and electricity from biomass fuels, where the heat load, being extremely variable in building heating and many other applications, dictates the amount of power that can be generated.

SUMMARY

A steam engine for use as a small scale power generator is disclosed. The steam engine utilizes a uniflow architecture, where steam enters at both ends of the cylinder and is released in the center of the cylinder. The valves used at either end are optimized so as to be pressure actuated, such that they open when the cylinder pressure is equal to or nearly equal to the boiler pressure. These valves eliminate the need for valve operating mechanisms, thereby reducing cost and complexity of the engine. Additionally, the steam engine utilizes inlet valves and piston seals that do not require lubrication, eliminating the use and expense of oil in the engine operation.

DETAILED DESCRIPTION OF THE INVENTION

Improvements to the steam engine for the purpose of small scale generation of electricity using biomass fuels and for co-generation of heat and electricity using biomass fuels in both developed and less developed countries are described. The engine is particularly well adapted to cogeneration where the thermal load, as in building heating and many process applications, is extremely variable, because of its ability to operate efficiently under partial load. For the same reason, it would be suited to solar generated steam. Experiments have been conducted with steam as the working fluid. The design may in some or all respects be applied to other working fluids.

As described above, a uniflow steam engine is disclosed. The uniflow steam engine of the present invention includes various innovations.

First, the steam engine utilizes steam inlet valves that are pressure actuated, that is, valves which open when cylinder pressure is equal to or nearly equal to boiler pressure, and which close due to a small pressure difference caused by the flow of steam into the cylinder. The present inlet valves do not require the use of a valve operating mechanism, present on previous steam engines, reducing the cost and complexity of the engine. The present valves automatically close and open in a manner that is optimal for maximum efficiency, and close earlier in response to an increase in engine speed, partially reducing the need for a speed governor.

Additionally, the steam engine includes inlet valves and piston seals which do not require lubrication, eliminating the expense of steam cylinder oil in engine operation, and the difficulty in separating oil from the exhaust steam and condensate, as well as the environmental hazard of disposing of used oil.

Figure 1:
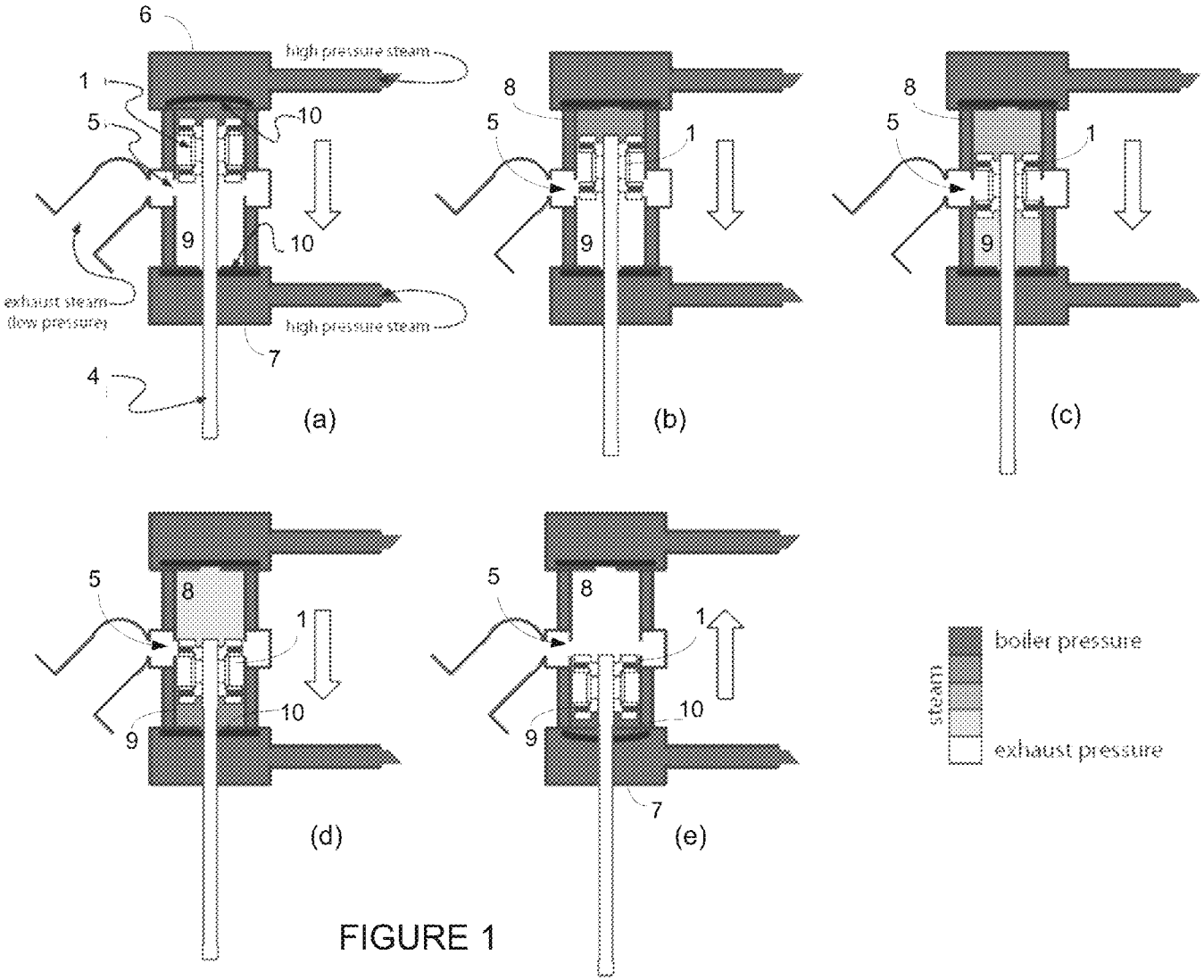
FIG. 1*a-e* is a sequence showing the operation of the engine according to one embodiment.

The operation of the engine of the present invention is best understood from the sequence of illustrations shown as FIG. 1.

The cylinder has two opposite ends, which interface with an upper steam chest 6 and a lower steam chest 7, respectively. One or more exhaust ports 5 are disposed on the walls of the cylinder. The cylinder is separated from the upper steam chest 6 by an upper valve plate 2, and is separated from the lower steam chest 7 by a lower valve plate 3. The upper valve plate 2 and the lower valve plate 3 are shown in more detail in FIGS. 3*a-b* and 4*a-b*, respectively. A piston 1 reciprocates in the cylinder. The piston 1 is connected to a piston rod 4, which is then attached at its distal end to a crankshaft (not shown).

The first figure (FIG. 1*a*) shows the piston 1 near top of its stroke. The upper inlet valve 10 is open (deflected upwards) and steam (at boiler pressure) begins entering upper cylinder from upper steam chest 6 (chamber) through upper inlet valve port. Steam is exhausting from lower cylinder 9 through cylinder exhaust ports 5 at exhaust pressure.

The second figure (FIG. 1*b*) shows the piston 1 pushed downward, expanding steam in upper cylinder 8. The upper inlet valve 10 has already closed due to steam flow through upper inlet port, causing sufficient pressure drop to close upper inlet valve 10. Exhaust steam in lower cylinder 9 is beginning to be compressed following closure of exhaust ports 5 by piston 1.

The third figure (FIG. 1*c*) shows the piston 1 continuing to be pushed downward, further expanding steam in upper cylinder 8 and compressing steam in lower cylinder 9.

The fourth figure (FIG. 1*d*) shows the piston 1 reaching the point where the pressure in upper cylinder 8 falls below pressure in lower cylinder 9. Exhaust ports 5 are about to open to the upper cylinder 8. Pressure in lower cylinder 9 is rising quickly as piston 1 approaches the lower cylinder head, but is not yet sufficient to open lower steam inlet valve(s) 10.

The fifth figure (FIG. 1*e*) shows the piston 1 has reached the bottom of its stroke. Steam is exhausted from upper cylinder 8 through cylinder exhaust ports 5. Lower inlet valve(s) 3 are open, due to exhaust steam recompression having caused lower cylinder pressure to equal boiler pressure. Steam at boiler pressure begins entering lower cylinder 9 from the lower steam chest 7 as piston 1 begins moving upwards in cylinder.

Figure 2:
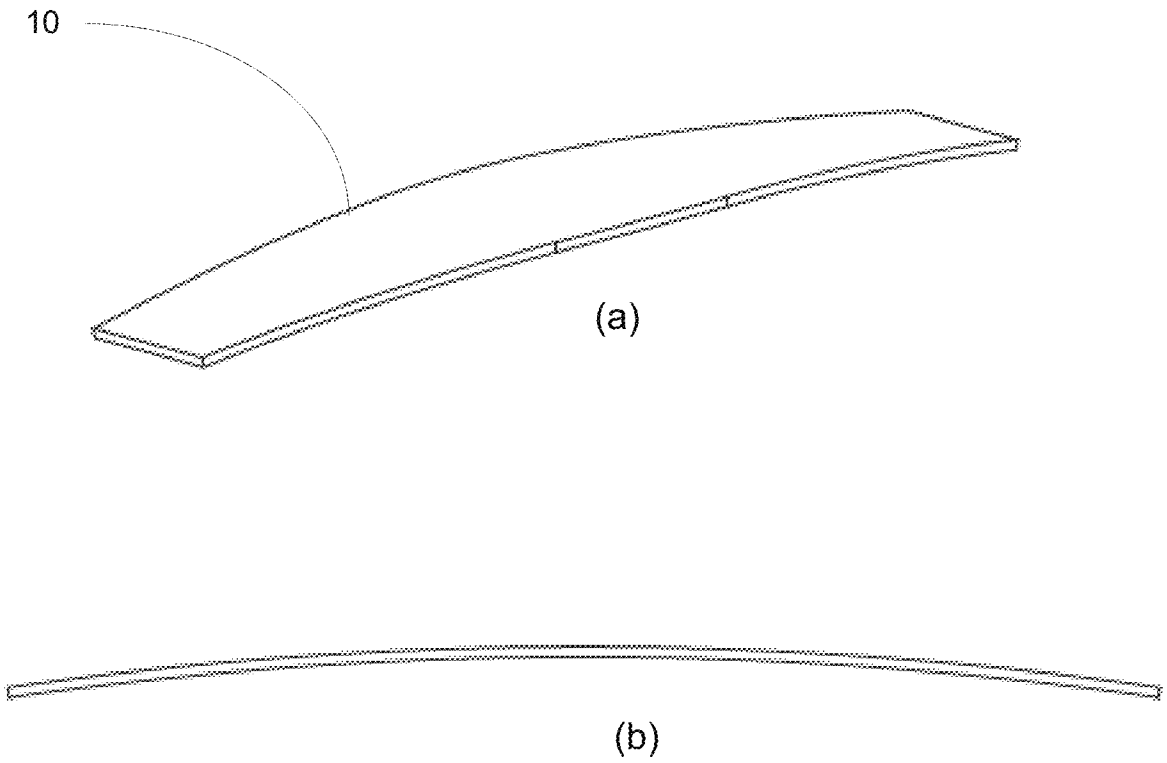
FIG. 2*a* illustrates a spring valve for use with the engine of FIG. 1.
FIG. 2*b* shows a cross-section of the spring valve of FIG. 2*a*.
Figure 3A:
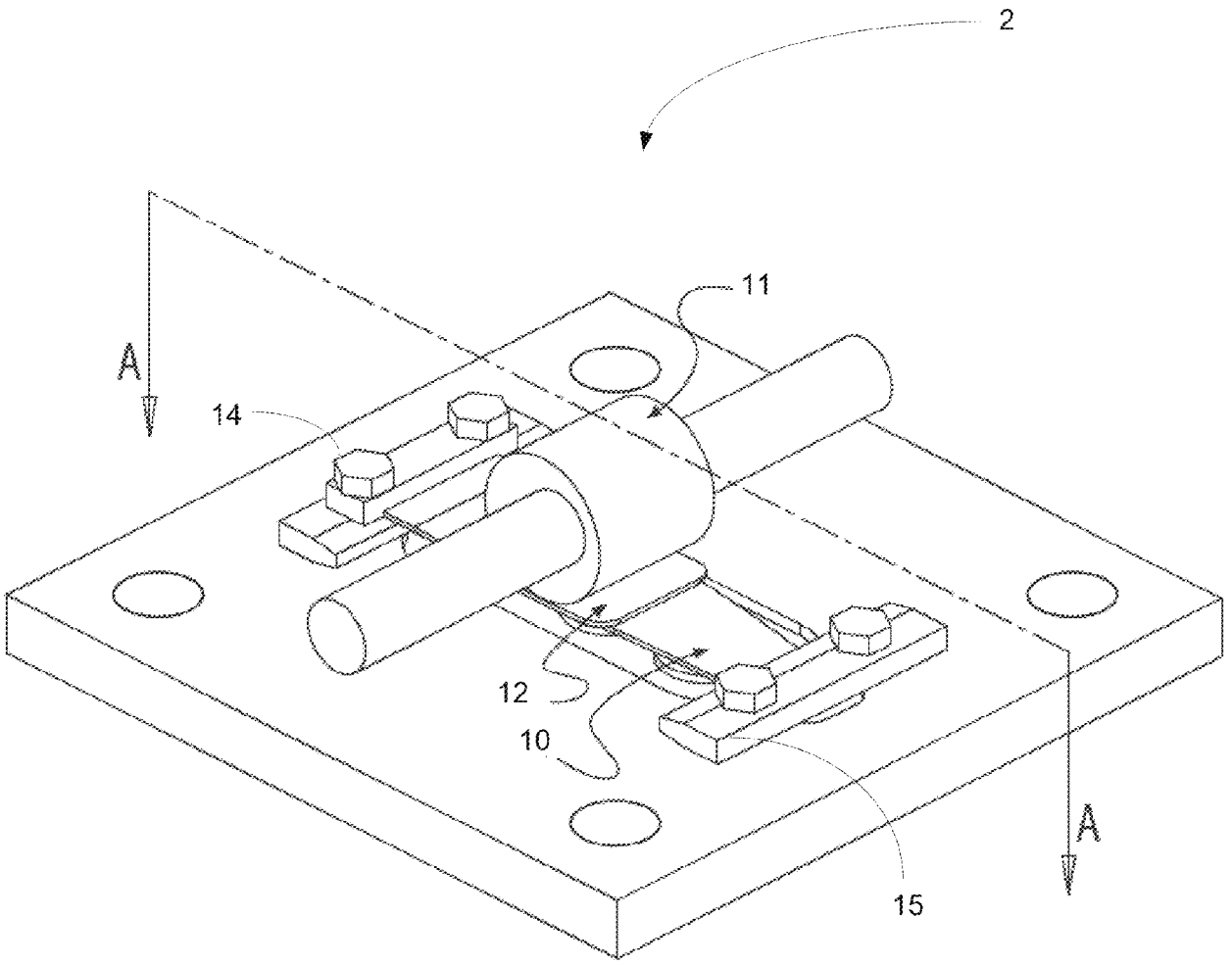
FIG. 3*a* illustrates an upper valve plate for use with the engine of FIG. 1.
Figure 4A:
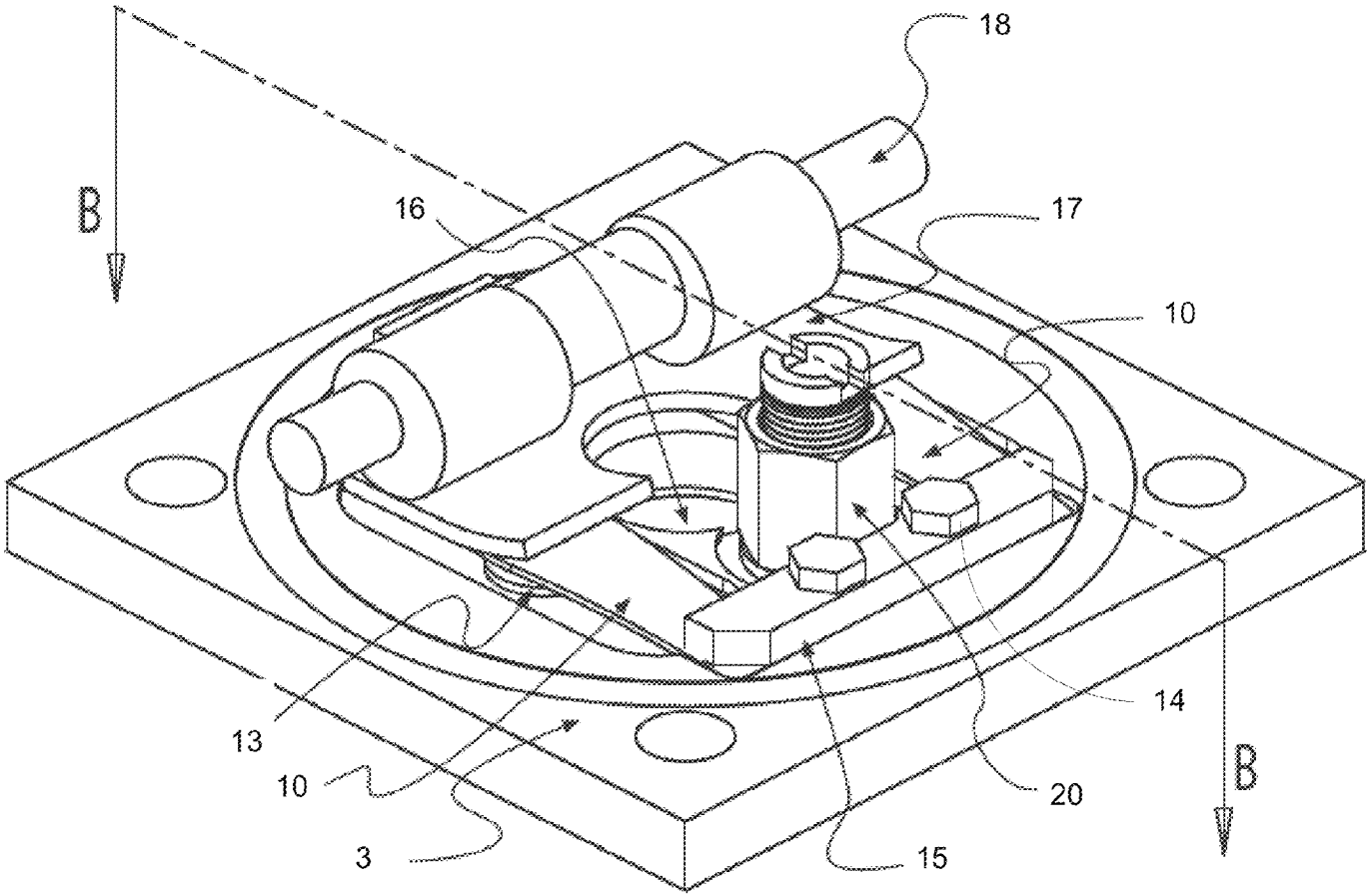
FIG. 4*a* illustrates lower valve plate for use with the engine of FIG. 1.

Inlet Valves:

FIG. 2*a* shows one embodiment of an inlet valve 10, which forms part of the upper valve plate 2 and lower valve plate 3 (see FIG. 3*a*, 4*a*). FIG. 2*b* shows a cross section of the inlet valve 10.

The inlet valves 10 in the present engine are stainless steel leaf springs, preformed lengthwise into an arched shape, therefore requiring a small pressure toward the engine cylinder to close against the valve seats. While stainless steel may be used, other materials may be suitable, such as any material that maintains its spring stiffness at elevated temperatures.

The use of a thin flexible material for the inlet valves 10 enables the valves to close quickly and with little impact force against the valve seats, and makes a leak resistant closure against the valve seats, even after they have uneven wear. Valves having single and multiple valve ports have been tested under a single valve spring, the latter arrangement being favorable for reducing the stress on the valve spring due to steam pressure (as the individual valve ports are typically smaller), and for providing reduced pressure drop across the valve ports, important for engines having larger cylinders and for high engine speeds.

The thickness of the leaf springs depends upon the length of the springs and the size of the ports, and is related to the piston diameter of the engine as well as the steam pressure supplied to the engine. Similarly, the spring constant is related to the total area of the valve ports. In one embodiment using test engines having cylinder diameters of approximately 4", leaf springs having a length of 5" and a thickness of 0.032" were utilized for the upper valves, while leaf springs having a length of 4" and a thickness of 0.024" were utilized for the lower valves at steam pressures up to 300 psi (20 bar), which steam was superheated to 700 degrees F. In other embodiments, larger steam chests may be utilized, which enable thicker, stronger leaf springs to be used, since longer inlet valves can be accommodated. The port diameters are 0.5" for the smaller inlet valves, and can be as large as 0.75" for the stronger, longer inlet valves.

Other shapes of thin flexible inlet valves are within the scope of this disclosure, including valves comprised of circles of thin flexible material, either single circles or rings or multiple concentric rings, and other shapes (as have been previously used in air compressors).

Figure 3B:
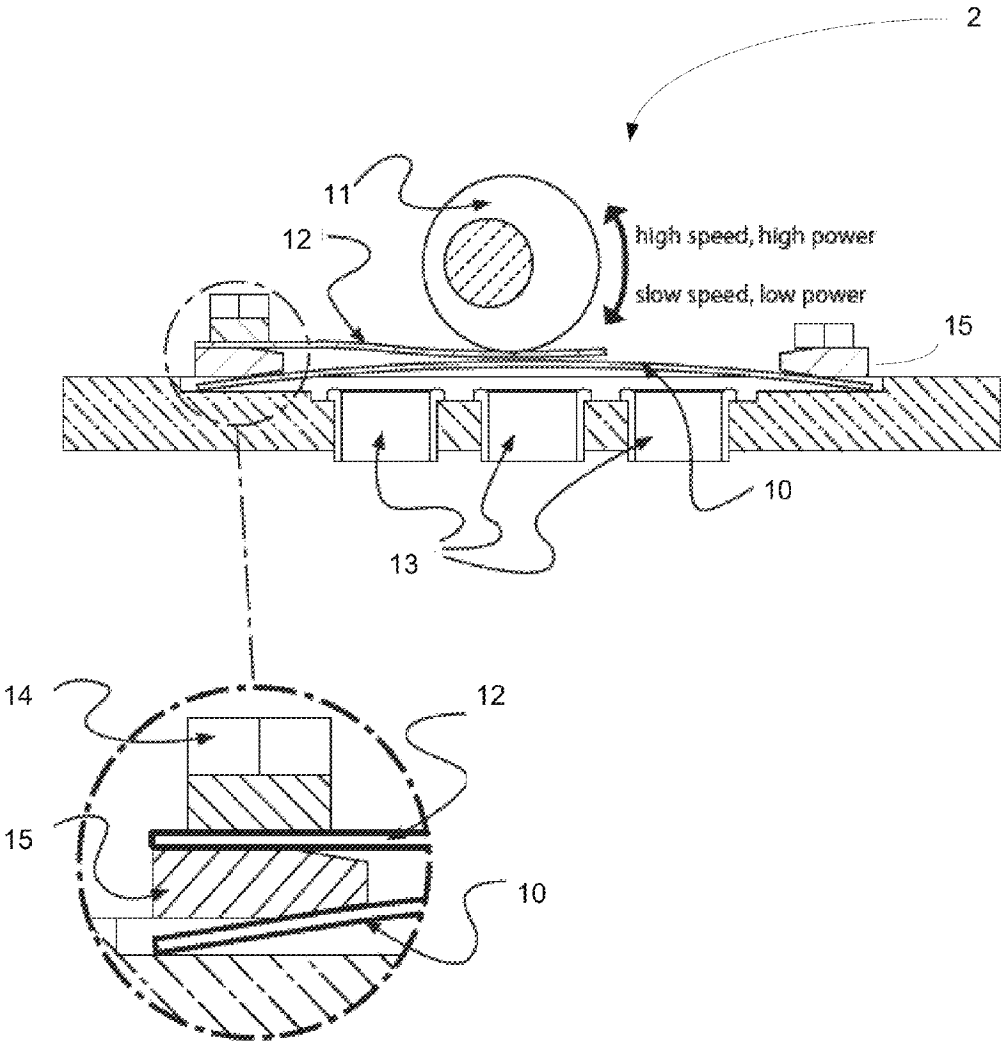
FIG. 3*b* shows a cross-section of the upper valve plate of FIG. 3*a*.

FIG. 3*a* shows an upper valve plate 2 used in one embodiment of the present invention. FIG. 3*b* shows a cross section of the upper valve plate of FIG. 3*a* along line A-A.

Figure 6:
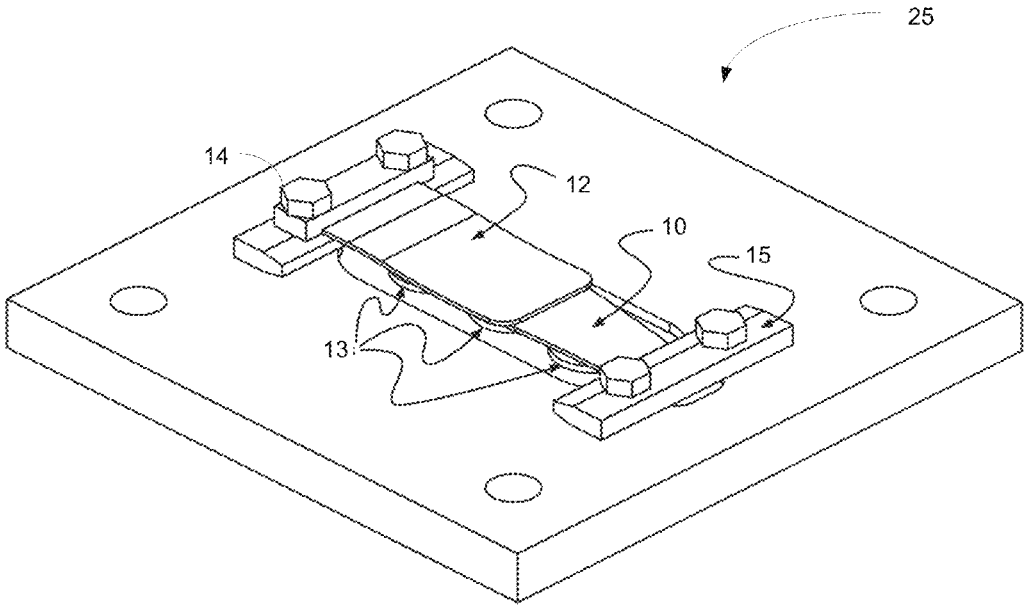
FIG. 6 shows an upper valve plate without a cam.

As seen in FIG. 3*a*, a camshaft 11, adjustable from outside the engine, is used to limit the maximum opening of the inlet valve 10. Reducing the maximum opening of the inlet valve 10 to about 1 millimeter causes the inlet valve 10 to close very early on the down stroke of the piston 1, reducing the steam consumption of the engine, but also reducing its speed, torque, and power output. Rotating the camshaft 11 to a position that allows the inlet valve 10 to open several millimeters, or as far as its unstressed curvature and fixed valve restraints may allow, requires a larger steam flow across the inlet valve 10 to force its closure, which delays closure to a point when the piston is further down in its stroke, or even the point of opening of the exhaust ports 5, enabling the engine to develop greater speed, torque, and power. In practice, the engine is extremely responsive to small changes in the position of the control cam 11. Other valve travel limiting mechanisms, including screws and other devices that are adjustable from outside the engine may be used to control its power output. In some embodiments, a cam 11 is not used. An upper valve 25 without a cam is shown in FIG. 6. All components are given the same reference designators as was shown in FIG. 3*a*.

An important advantage of the pressure actuated inlet valve is its inherent tendency to close earlier in the piston's stroke as the engine speed increases, and to close later as the engine speed is reduced, in response to a decrease or increase in load (resistive torque) on the engine, respectively. This causes an engine fitted with these inlet valves 10 to be somewhat speed regulated without resorting to an external speed regulating mechanism (governor). Whereas accurate speed regulation under large load fluctuations or fluctuations in boiler pressure would require a governor, or manual adjustment of the camshaft position by the operator, an ungoverned engine of the present design, or an engine subjected to a governor failure, would be much less likely to be damaged and to damage its connected equipment due to over speed.

Another advantage of the present inlet valve design is that the engine may not be damaged due to the presence of water in the cylinder of the engine, which is a frequent occurrence in steam engines during start up. Conventional steam engines required considerable care during start up, or the use of condensate relief valves at the ends of the cylinder, to avoid water becoming trapped between the piston and cylinder heads. Water is almost entirely incompressible, and can break the cylinder heads or other parts of a conventional steam engine fitted with mechanically operated valves. The present inlet valves 10 open as cylinder pressure equals or exceeds boiler pressure, thereby eliminating any risk to the engine from entrapped water.

A final advantage of the present inlet valve 10 is its ability to operate without lubrication. The only friction experienced by the inlet valve 10 is due to the very slight movement of the ends of the inlet valve 10, against the supporting surfaces of the valve plate or cylinder head as the inlet valve 10 flexes (see insert on FIG. 3*b*). Very little wear has been exhibited by these inlet valves 10 despite the high operating temperature (up to 700° F., at present) and lack of lubrication.

An important characteristic of the present pressure actuated inlet valves 10, which distinguish them from a common check valve, is that they are formed in an arch shape so that they are normally open. It is important that the inlet valves remain in the open position, against the camshaft lobe 11, until the pressure drop across the inlet valve 10, proportional to steam flow, is sufficient to close the inlet valve 10. In practice, shown in FIG. 3*a*, a snubber spring 12 or cam follower may be helpful between the inlet valve 10 and the cam lobe 11, to reduce the stress on the inlet valve 10 as it strikes the valve cam 11 to reduce the incidence of inlet valve breakage.

FIG. 3*b* shows a cross-sectional view of the upper valve plate 2. This upper valve plate 2 is disposed between the upper cylinder 8 and the upper steam chest 6 (see FIG. 1*a*), and provides the boundary between these two cavities.

As can be readily seen, the inlet valve 10 is held in place on both sides of the valve ports 13. The valve ports 13 allow the passage of steam from the upper steam chest 6 into the upper cylinder 8, as can be seen in FIG. 1*a*.

In some embodiments, one or more bolts 14 are used on each side of the valve ports 13 to retain the inlet valve 10 in place. A valve retainer 15 may be disposed above the inlet valve 10 so as to hold it in place, while allowing some movement during opening and closing. As described above, in some embodiments, a snubber spring 12 is used to control the rate at which the inlet valve 10 opens and to spread the load of valve contact with the control cam over a larger area of the valve. In some embodiments, the snubber spring 12 may be disposed above the valve retainer 15, as shown in the insert on FIG. 3*b*. This assembly (i.e. the inlet valve 10, the valve retainer 15 and the snubber spring 12) may be held in place through the use of one or more bolts 14.

Figure 4B:
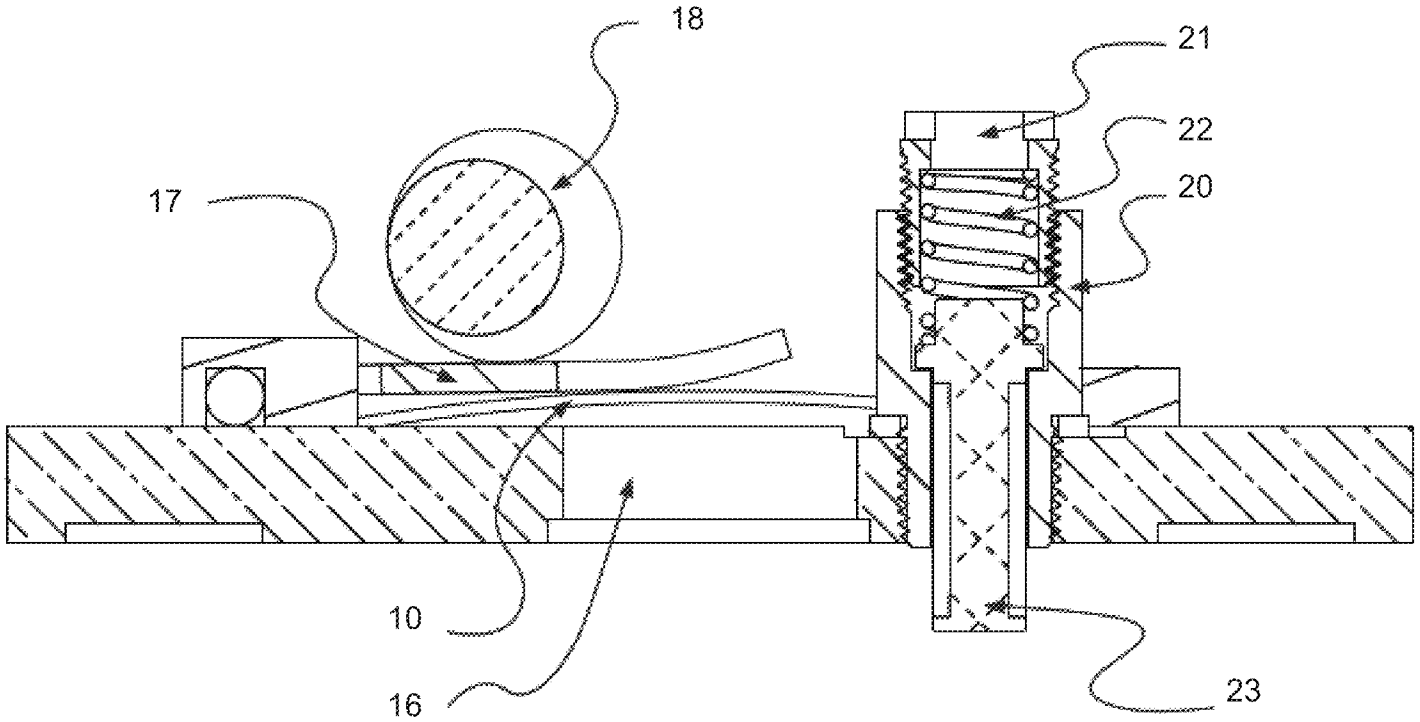
FIG. 4*b* shows a cross-section of the lower valve plate of FIG. 4*a*.

FIG. 4*a* shows a lower valve plate 3. FIG. 4*b* shows a cross section of that lower valve plate 3 along line B-B. Note that both of these figures are shown in the inverted position. The lower valve plate 3 is fundamentally different than the upper valve plate 2 in that the piston rod 4 must pass through a hole 16 in the lower valve plate 3. Thus, the lower valve plate 3 may have a different number of valve ports 13 than the upper valve plate 2 in some embodiments.

Like the upper valve plate 2, the lower valve plate 3 may include a lower cam 18 to control the amount that the inlet valves 10 can open. However, due to the presence of the piston rod 4, the shape of the lower cam 18 may differ from the shape of the cam 11 used in the upper valve plate 2. A valve cam fork 17 may be disposed on the inlet valves 10 to serve as a contact surface for the valves, which surface is displaced laterally and is of larger radius than the surface of the cam. This functions similar to the snubber described above. As described above, the inlet valves 10 may be retained using valve retainer 15 and bolts 14.

FIGS. 4*a*, 4*b* also show a pilot valve 20, which may aid in regulating the passage of steam, especially during startup. This pilot valve 20 is described in more detail below.

A significant limitation imposed by the pressure actuated inlet valve 10 is that it will not open until the cylinder pressure nearly equals the boiler pressure, or, more accurately, the steam pressure in the chamber directly above the inlet valve 10. Normally, such high cylinder pressure is not achieved until the engine is running at a certain minimum speed. This problem may be overcome in the present engine by installing a small plunger on the piston rod 4 which enters the central valve port 13 of the upper cylinder head and pushes open the inlet valve 10 slightly as the piston reaches top dead center. This engine is then started by relieving all steam pressure from the engine steam chests (chambers) 6,7, and manually placing the flywheel in a position that is a few degrees either side of top dead center. When steam is allowed to enter the engine, its pressure will act downwards on the top of the piston 1 through the open upper inlet valve 10, which is prevented from closing by the fact that the piston 1 is not yet in rapid motion. The lower inlet valve 10 closes quickly due to unrestricted steam flow from the lower steam chest 7 through the exhaust ports 5 being open toward the lower end of the cylinder. The engine accelerates rapidly even though the lower inlet valve 10 may not open until a certain minimum speed is achieved.

Another solution that may be used to ensure opening of the inlet valves 10 at boiler pressures in excess of the pressure achieved by recompression of exhaust steam, which was found in one prototype to be 15 to 20 Bar, when the engine exhausts to atmospheric pressure, is to install a small pilot valve 20 in each of the cylinder heads. One such pilot valve 20 is shown in FIGS. 4*a,b*. The purpose of these pilot valves 20, with which the piston 1 makes contact as it reaches top and bottom center, is to allow enough steam to enter the clearance space between the piston 1 and cylinder head to equalize pressure between the cylinder and steam chests 6, 7, thereby allowing the main pressure actuated inlet valves 10 to open. Either this method, or the use of a projection on the piston or valve, which enables the piston to push open at least one valve port 13 of the pressure actuated valve near the end of the piston's travel, enables the engine to operate at boiler pressures well above the pressure achieved by recompression of exhaust steam.

A pilot valve 20 is also shown in FIGS. 4*a* and 4*b*. The pilot valve 20 is held in place by a retainer 21, such as a screw. A plunger 23 extends into the lower cylinder 9 and is biased in this position by a coil spring 22. This bias force is supplemented due the pressure differential between the lower steam chest 7 and the lower cylinder 9. When the bottom surface of the piston 1 contacts the plunger 23, it forces the plunger upward (i.e. away from the cylinder). The force required to move the plunger is reduced in this scenario, as the pressure in the lower cylinder 9 is nearly equal to the pressure in the lower steam chest 7, due to the recompression of the exhaust steam present in the lower cylinder 9.

When the plunger is moved, it admits sufficient steam into the small volume of the lower cylinder 9 (see FIG. 1*d*) to equalize the pressure between the lower cylinder 9 and the lower steam chest 7, thereby enabling the inlet valves 10 to open.

In summary, a novel inlet valve for engines is disclosed. The inlet valve is designed to control the duration of admission of a compressed gas, including but not limited to steam, to the cylinder of the engine, so as to control the power and speed of said engine, and to use the energy of expansion of said gas to provide power to the engine after closure of the inlet valve, thereby maximizing engine efficiency. This inlet valve is comprised of a spring, or incorporates a spring separate from the valve itself, which holds the inlet valve open with a light pressure against an externally adjustable stop, such as a cam. The inlet valve has the important characteristics of exerting a governing effect on the speed of the engine, and does not require lubrication.

Piston and Piston Seal:

The design of a conventional steam engine is such that the piston 1 is subject to little or no side loading, since the reaction force of the angled connecting rod, acting perpendicular to the line of piston travel, is supplied by a guide assembly, called a cross head, that is independent of the piston and separately lubricated. The nature of a steam engine therefore allows for the possibility of oil-free operation. This was not attempted in most previous steam engines because most engines used metallic piston seals or piston rings, which exert a large rubbing force on the cylinder. A few engines which did not employ piston rings required a very close clearance between the piston and cylinder to provide a very imperfect seal, sometimes improved by the use of paraffin and/or a flexible packing rope.

The present engine requires the use of exhaust ports 5 cut through the cylinder wall to exhaust steam from the cylinder near the end of the piston's stroke. For this reason, it is not possible for the present engine to use a flexible rope packing, or other sealing material that is subject to tearing, abrasion, or ablation. As the present engine is also intended to operate in co-generation, where the exhaust steam may be distributed for building heating and other applications, it is valuable to eliminate the use of oil in lubrication of the steam piston and piston seals. Furthermore, the elimination of oil as a lubricant in the steam cylinder enables the engine to operate with higher temperature steam, improving its efficiency, and avoids oil contamination of the inside of the boiler, and eventually the environment.

The nature of a split or segmented piston ring, floating in a groove in the piston, is that it exerts a contact pressure on the cylinder wall equal to the difference in the pressure of the gas (or steam) acting across the ring. As an example, a piston ring having a thickness of 0.2 inch, providing a seal between a cylinder pressure of 300 pounds per square inch and an exhaust pressure of 15 pounds per square inch in a cylinder of 4 inch diameter exerts a contact pressure against the cylinder of 300−15=285 pounds per square inch, and a total contact force of:

$$0.2\ \text{inch} \times 4\ \text{inch} \times 3.14 \times 285\ \text{pounds/square inch} = 716\ \text{pounds}$$

It is apparent that the sliding of a force of this magnitude at the high speed of an engine piston requires that the friction between the sealing ring and cylinder of the engine be minimized in order to reduce the power loss due to friction and to make the engine long lasting. In engines having metallic piston rings, including the majority of steam engines and virtually all internal combustion engines, this is done by the use of an oil film.

Figure 5A:
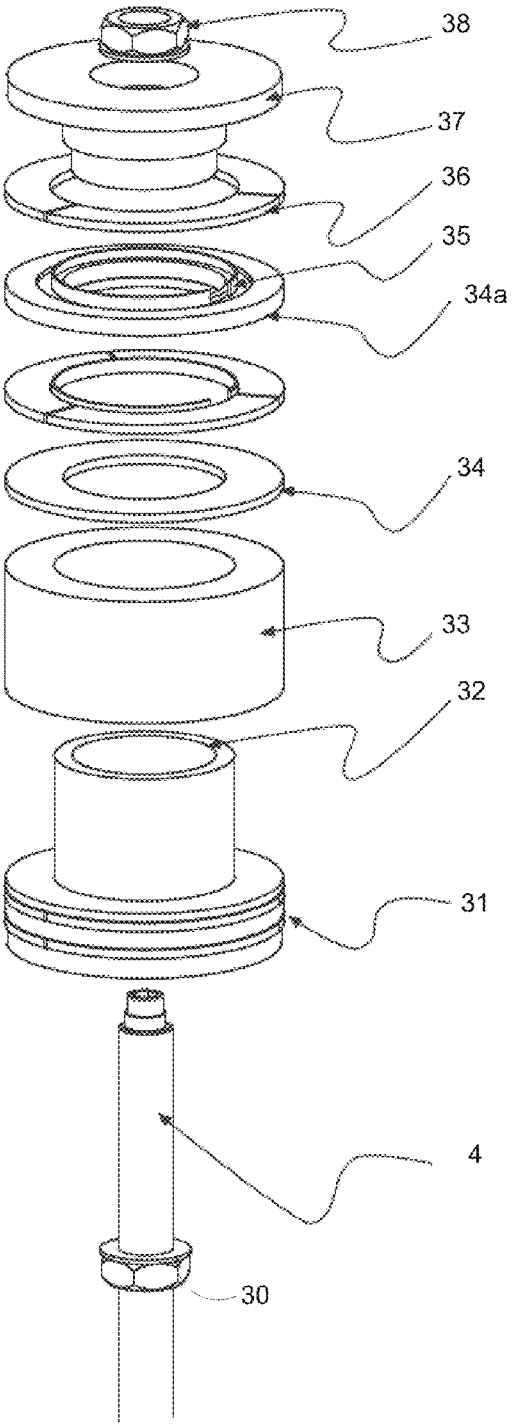
FIG. 5*a* is an exploded view of a piston for use in one embodiment.

The present disclosure has identified various approaches to eliminate the need for oil in its steam engine cylinder. These are shown in FIGS. 5*a*-5*c*.

Figure 5B:
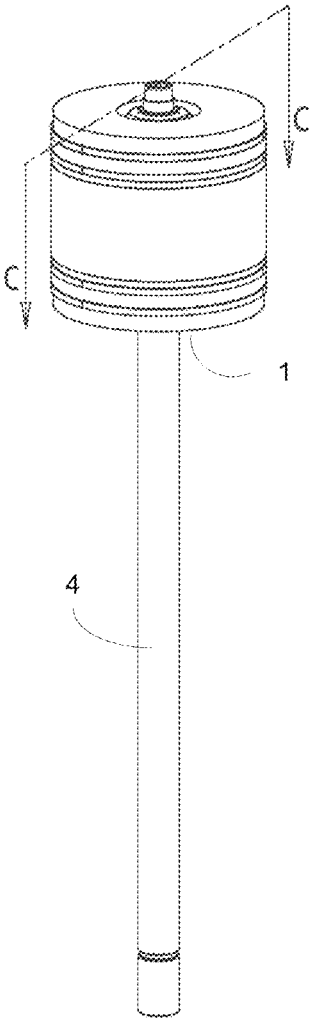
FIG. 5*b* is an assembled piston for use in one embodiment.
Figure 5C:
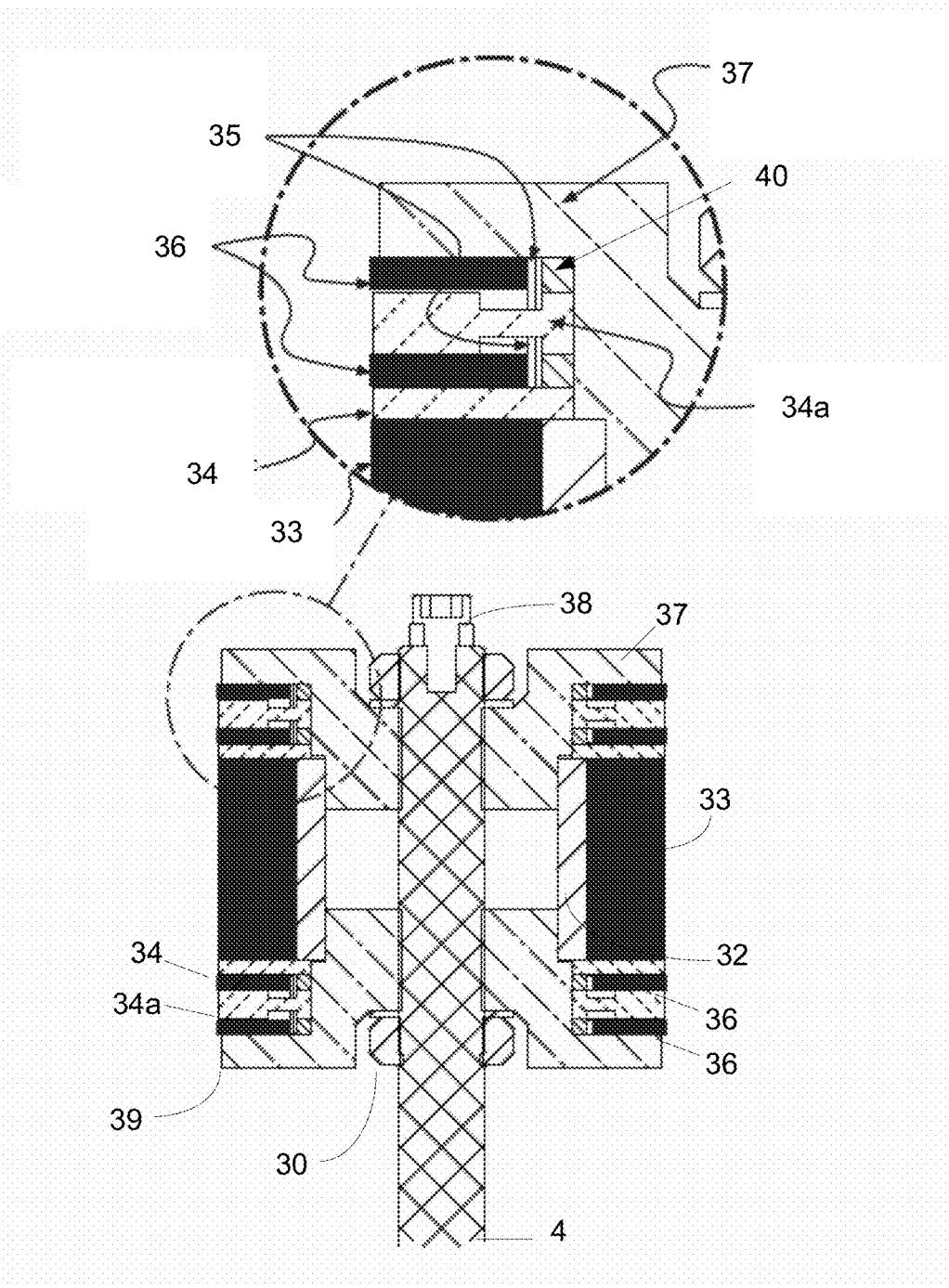
FIG. 5*c* is a cross-section of the piston of FIG. 5*b*.

FIG. 5*b* shows an assembled piston 1 that an attached piston rod 4. FIG. 5*a* shows an exploded view of this piston 1. FIG. 5*c* shows a cross-sectional view of the piston 1.

A lower nut 30 is disposed on the piston rod 4. A lower seal assembly 31 is then disposed on the lower nut 30. The lower seal assembly 31 includes one or more piston discs 34, seal springs 35, graphite rings 36, as described in more detail below. The lower seal assembly 31 also includes a lower piston cap 39 (see FIG. 5*c*).

A piston body 32 is disposed on the lower seal assembly 31. The piston body 32 has a radius smaller than the cylinder, and may be constructed of aluminum or another material. An annular graphite bushing or sleeve 33 is disposed over the piston body 32. One or more piston discs 34 are disposed above the graphite bushing 33. These piston discs 34 may be brass or some other suitable material. In some embodiments, the piston discs 34 may be metal, however, in other embodiments, non-metallic materials, such as ceramic or carbon fiber may be utilized. As best seen in FIG. 5*c*, one or more of the piston discs 34 may include retainer grooves (see disc 34*a*) for the purpose of accommodating flat seal springs 35 that are wider than the separation between adjacent piston discs 34. These seal springs 35 are disposed along the inner circumference of the graphite rings 36 and urge the graphite rings 36 outward toward the cylinder walls. These seal springs 35 are captive within the outward diameter of the seal spring retainer groove, and may not escape the piston even in the event of total failure of the graphite seals 36. An upper piston cap 37 is disposed above the entire assembly and held in place with an upper nut 38.

In some embodiments, the upper and lower piston caps 37, 39 are threaded on to the piston rod 4 and locked in place with nuts 30,38.

The upper piston cap 37, the graphite rings 36, the seal springs 35 and the piston discs 34, 34*a* described above form a upper seal assembly. This upper seal assembly may identical in configuration to the lower seal assembly 31 (see FIG. 5*a*). In other words, the piston 1 may be symmetric about its two ends, with the exception of the piston rod 4, which extends from only one end of the piston.

Thin segmented graphite rings 36 provide an effective gas seal for reducing steam leakage past the piston, are reasonably long wearing, and do not require lubrication. These graphite rings 36 may comprise graphite, however composites or other compounds that include graphite are also within the scope of the disclosure. For example, the rings 36 may be constructed of metal impregnated graphite or a graphite/carbon fiber material. In other embodiments, the rings 36 may be made from another form of carbon. Thus, the term "graphite rings" as used in this disclosure, includes rings containing pure graphite, rings containing a combination of graphite and one or more other materials, or rings containing other forms of carbon.

As stated above, one or more deep but thin segmented graphite rings 36 are installed within deep grooves in the piston body, or between piston discs 34 and 34*a*. As stated above, the piston discs 34 may be made of polished brass, or another material, which may be found not to abrade the sides of the graphite ring 36, nor to be abraded due to light contact with the cylinder.

In some embodiments, the segmented graphite rings 36 have a thin metal seal spring 35 acting against the inside circumference of the graphite ring 36, in order to urge the graphite ring 36 outward and maintain contact between the graphite ring 36 and the cylinder, particularly when there is no gas pressure acting across the graphite ring 36. Such seal springs 35 may be slightly wider than the graphite segmented ring 36, and be retained by recesses in the sides of the piston grooves located in piston disc 34*a*, in order to prevent a seal spring 35 from leaving the piston groove in the event of graphite ring disintegration.

In some embodiments, as seen in the insert to FIG. 5*c*, spacer rings 40 may be disposed between the piston disc with retainer grooves 34*a* and the adjacent components, such as piston disc 34. The spacer rings 40 serve to guarantee spacing between adjacent piston discs to create gaps for the graphite seals 36. The graphite seals 36 may be disposed between piston discs 34, 34*a* in the gap created by spacer ring 40.

FIG. 5*c* shows one piston disc 34, one piston disc with a retaining groove 34*a*, two spacer rings 40 and two graphite rings 36. However, the disclosure is not limited to this embodiment. Indeed, any number of piston discs 34 and piston discs with retaining grooves 34*a* may be included in the piston 1. One or more graphite rings 36 may be disposed between each pair of adjacent piston discs 34, 34*a*. Thus, while two graphite rings 36 are shown in the upper seal assembly of FIG. 5*c*, an increased number of graphite rings 36 may be used. In a preferred embodiment, a spacer ring 40 is used to create a gap between each two adjacent piston discs 34, 34*a* and one or more graphite rings 36 are disposed in each respective gap. By increasing the number of piston discs 34, 34*a*, an increased number of spacer rings 40 may be needed. Consequently, more gaps are created, allowing the use of more graphite rings 36. An increased number of graphite rings 36 may increase the seal life of these components.

The deep grooves in the portion of the piston that accommodate the piston rings may be constructed of multiple rigid discs of polished brass, or other suitable material, and the balance of the piston made of aluminum to reduce the weight of the piston. This allows the graphite seal springs 35 to be installed during assembly of the piston on its piston rod.

In some embodiments, the outer circumference of the graphite bushing or sleeve 33 and the outer circumference of the segmented graphite seals 36 are greater than the outer circumference of the piston discs 34. In this way, only components constructed of graphite are able to contact the sidewall of the cylinder.

The piston 1 of a steam engine is typically symmetric, consisting of upper and lower elements, each enclosing one or more piston rings, as described above. In the case of the uniflow type of steam engine, including the present engine, the upper and lower piston elements are separated by a spacer bushing, such as piston body 32, such that the overall length of the piston is approximately equal to the overall length of the cylinder minus the length of the cylinder exhaust ports, this quantity divided by two. It has been found convenient, for the purpose of minimizing or eliminating contact between the outside edges of the piston discs 34 and the engine cylinder, to install a graphite bushing 33 around this piston body 32, and between said upper and lower piston assemblies. This graphite bushing 33 may be slightly larger in diameter than the piston discs 34, at engine operating temperature, such that the only surfaces of the piston contacting the cylinder at engine operating temperature are the graphite rings 36 and the graphite bushing 33.

It has been discovered that graphite acquires increased toughness when used as the sealing rings in a steam engine, due to the absorption of moisture by the graphite. This is true even when the steam used in the engine is superheated to several hundred degrees Fahrenheit above the saturation temperature.

The use of graphite in the graphite rings 36 and the graphite bushing 33 reduces the amount of friction between the piston 1 and the inner walls of the cylinder. In some embodiments, this reduction in friction is significant so as to eliminate the need for a lubricant in the cylinder.

While the disclosure refers to the graphite rings 36 are being segmented, other embodiments are within the scope of the disclosure. For example, the graphite rings 36 may be split or elastic.

In addition, in some embodiments, the inner walls of the cylinder are coated with a nitride. This improves corrosion resistance of the cylinder, but may also reduce friction on the graphite rings 36, increasing seal life and engine efficiency.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. These other embodiments and modifications are intended to fall within the scope of the present disclosure. Furthermore, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A steam engine comprising:

a cylinder, having two ends and a sidewall, having an exhaust port disposed in said sidewall;

a reciprocating piston disposed in said cylinder, separating said cylinder into an upper cylinder region and a lower cylinder region, said reciprocating piston in communication with a piston rod;

an upper steam chest, disposed at one end of said cylinder;

a lower steam chest, disposed at a second end of said cylinder, wherein said piston rod extends through said lower steam chest;

an upper valve plate comprising:

an upper valve port passing through said upper valve plate and connecting said cylinder and said upper steam chest; and an upper inlet valve, disposed above said upper valve port and retained in place by an upper valve retainer, wherein said upper inlet valve comprises a stainless steel leaf spring, normally biased in an arched shape so as to allow passage of steam between said upper steam chest and said cylinder in an open position; and a lower valve plate comprising:

a hole passing through said lower valve plate, wherein said piston rod passes through said hole;

a first and second lower valve port passing through said lower valve plate and connecting said cylinder and said lower steam chest, wherein said first and second valve port are disposed on opposite sides of said hole;

a first and second lower inlet valve, each disposed below said first and second lower valve port, respectively, and retained in place by a lower valve retainer, wherein said first and second lower inlet valve each comprises a stainless steel leaf spring, normally biased in an arched shape so as to allow passage of steam between said lower steam chest and said cylinder in an open position;

a lower cam engaging a valve cam fork with two projections and a recess therebetween, wherein said recess is aligned with said hole and accommodates said piston rod and wherein each of said first and second lower inlet valve is disposed between a respective projection and said lower valve plate; and a pilot valve disposed on said lower valve plate, said pilot valve comprising:

a plunger, a retainer, and a coil spring disposed between said retainer and said plunger exerting a bias force to cause said plunger to extend into said lower cylinder region, such that when said piston is in a lower position, said piston contacts said plunger, overcoming said bias force, thereby allowing steam to pass between said lower steam chest and said lower cylinder region, and wherein pressure created by a flow of steam from said upper steam chest into said upper cylinder region causes said upper inlet valve to deflect to a closed position, wherein said upper inlet valve seals against said upper inlet port, thereby preventing the flow of steam between said upper steam chest and said upper cylinder region and wherein pressure created by a flow of steam from said lower steam chest into said lower cylinder region causes said first and second lower inlet valve to deflect to a closed position, wherein said first and second lower inlet valve each seals against a respective lower inlet port, thereby preventing the flow of steam between said lower steam chest and said lower cylinder region.

2. The steam engine of claim 1, wherein said upper inlet valve transitions from said closed position to said open position when pressure within said upper cylinder region equals pressure in said upper steam chest, and wherein said first and second lower inlet valve each transitions from said closed position to said open position when pressure within said lower cylinder regions equals pressure in said lower steam chest.

3. The steam engine of claim 2, further comprising an upper cam disposed above said upper valve plate, said upper cam positioned so as to contact said upper inlet valve when in said open position, wherein said upper cam is rotatable to vary the maximum opening achieved by said upper inlet valve when in said open position.

4. The steam engine of claim 3, further comprising a snubber disposed above said upper inlet valve, said snubber adapted to control a rate at which said upper inlet valve opens and contacts said upper cam.

5. The steam engine of claim 2, further comprising a projection disposed on an upper surface of said piston, such that when said piston is in an upper position in said cylinder, said projection passes through said upper valve port and deflects said upper inlet valve from said closed position.

6. The steam engine of claim 1, wherein as said piston reciprocates, there is a first portion of the engine cycle where said upper cylinder region expands while said lower cylinder region is compressed, and a second portion of the engine cycle where said upper cylinder region is compressed while said lower cylinder region expands, and wherein the upper inlet valve moves to said closed position during said first portion and remains in said closed position until a point in the second portion when the pressure within said upper cylinder region equals pressure in said upper steam chest.

7. The steam engine of claim 1, wherein said piston comprises one or more graphite seals.

8. The steam engine of claim 7, wherein said piston further comprises two or more piston discs, each adjacent pair of piston discs separated by a respective spacer ring, wherein one or more of said graphite seals are disposed within a gap created by said respective spacer ring between said adjacent piston discs.

9. The steam engine of claim 8, further comprising a graphite bushing disposed over a portion of said piston, wherein an outer circumference of said graphite bushing and an outer circumference of said graphite seal are greater than an outer circumference of said piston disc such that only said graphite bushing and said graphite seals contact said sidewall of said cylinder.

10. The steam engine of claim 8, further comprising a seal spring, disposed in said gap and against an inner circumference of said graphite seal, said seal spring urging said graphite seal toward said sidewall of said cylinder.

11. The steam engine of claim 8, wherein said sidewalls are nitride coated.

* * * * *